US005618008A

United States Patent [19]

Dearwester et al.

[11] Patent Number: 5,618,008

[45] Date of Patent: Apr. 8, 1997

[54] APPARATUS FOR DISPENSING MULTIPLE PRODUCTIONS FROM A SINGLE TISSUE ROLL HOLDER

[75] Inventors: Donald D. Dearwester, Las Vegas, Nev.; John W. Toussant, West Chester, Ohio

[73] Assignee: The Procter & Gamble Company, Cincinnati, Ohio

[21] Appl. No.: 579,801

[22] Filed: Dec. 28, 1995

[51] Int. Cl.[6] ..... A47K 10/22

[52] U.S. Cl. ..... 242/594.5; 242/598.5

[58] Field of Search ..... 242/549.9, 598, 242/598.3, 598.5

[56] References Cited

U.S. PATENT DOCUMENTS

| | | | |
|---|---|---|---|
| 2,122,048 | 6/1938 | Shapiro | 206/57 |
| 3,409,340 | 11/1968 | Clark | 242/598.5 |
| 3,794,253 | 2/1974 | Megdall . | |
| 3,799,467 | 3/1974 | Bauman . | |
| 3,834,636 | 9/1974 | Linick | 242/598.5 |
| 3,837,595 | 9/1974 | Boone . | |
| 3,848,822 | 11/1974 | Boone . | |
| 3,910,229 | 10/1975 | Spencer | 118/43 |
| 3,943,859 | 3/1976 | Boone | 108/50 |
| 3,995,582 | 12/1976 | Douglas | 118/43 |
| 4,205,802 | 6/1980 | Economakis | 242/594.5 |
| 4,410,221 | 10/1983 | Vallis et al. . | |
| 4,483,491 | 11/1984 | Rainey . | |
| 4,834,316 | 5/1989 | DeLorean | 242/594.5 |
| 4,913,312 | 4/1990 | Boutin | 221/45 |
| 5,012,986 | 5/1991 | Needle . | |
| 5,248,105 | 9/1993 | Cooker | 242/598.5 |
| 5,311,986 | 5/1994 | Putz | 242/598.5 |
| 5,332,118 | 7/1994 | Muckenfuhs | 221/48 |
| 5,464,170 | 11/1995 | Mitchell et al. | 242/598 |

*Primary Examiner*—John P. Darling

*Attorney, Agent, or Firm*—Larry L. Huston; E. Kelly Linman; Jacobus C. Rasser

[57] ABSTRACT

An apparatus for dispensing toilet tissue and at least one other product includes a top wall and two opposing side walls connected together to form a housing. The apparatus is readily attachable to ordinary toilet tissue roll holders using a spindle of the roll holder and without the need for adhesives. The apparatus receives at least one roll of toilet tissue by a spindle or by other known hardware. The top wall is adapted for holding additional products.

17 Claims, 7 Drawing Sheets

APPARATUS FOR DISPENSING MULTIPLE PRODUCTIONS FROM A SINGLE TISSUE ROLL HOLDER

FIELD OF THE INVENTION

The present invention relates to an apparatus for dispensing toilet tissue in conjunction with at least one other product. The invention has even further relation to such an apparatus which is readily attachable to an ordinary toilet tissue roll holder without the need for additional adhesives, hardware or the like.

BACKGROUND OF THE INVENTION

Ordinary toilet tissue roll holders have been well known for many years and are found in almost every household. Typically, these toilet tissue roll holders comprise a spring-loaded spindle which is inserted into a rigid member having a pair of opposing holes. These holes are either recessed within a bathroom wall or extend from a bathroom wall.

Recently there has been a desire to supplement ordinary toilet tissue with other personal products, such as wet toilet wipes. Consumers have shown a preference for having wet toilet wipes near the toilet tissue in the bathroom and—thus—easily accessible. However, using products such as wet toilet wipes requires another dispenser, in addition to the spindle used to dispense the toilet tissue.

There have, therefore, been attempts to provide an apparatus that can dispense both ordinary toilet tissue and at least one other product. One example of such an apparatus is given in U.S. Pat. No. 3,799,467, issued to Bauman on Mar. 26, 1974. Bauman discloses a toilet tissue holder and shelf combination. However, Bauman has the drawback that the toilet tissue and shelf combination are adapted to be attached to the side wall of a flush tank or other vertical support means, rather than to the existing tissue roll holder. Although the pre-existing roll holder is still present in the bathroom, it is not utilized.

One solution to this problem was to provide an apparatus for dispensing toilet tissue and another product, which apparatus is readily attachable to an ordinary toilet tissue roll holder. An example of this attempt is illustrated by U.S. Pat. No. 3,943,859, issued to Boone on Mar. 16, 1976. Boone discloses a shelf-like device which is readily attachable to an ordinary toilet tissue roll holder and does not interfere with the dispensing of the toilet tissue. However, Boone has the drawback that the shelf is unstable and requires adhesives or other hardware to hold the shelf in place. Boone requires considerable installation time, becomes permanent, and therefore would not be commercially acceptable. Furthermore, the Boone device cannot attach itself to recessed roll holders and therefore is not applicable to a wide range of existing roll holders.

Another example of an apparatus for dispensing toilet tissue and another product and which is readily attachable to an ordinary toilet tissue roll holder is illustrated by U.S. Pat. No. 3,794,253, issued to Megdall on Feb. 26, 1974. Megdall discloses a toilet paper roll holder further equipped to support a box of tissues. Megdall has the drawback of using resilient rod members that need to be disposed against a wall in order to put pressure against the box of tissues to be supported. This pressure makes the structure unstable and may damage the wall. While Megdall is capable of supporting a roll of toilet paper and a box of facial tissues or the like, it is not well adapted to carry irregularly shaped products, such as commonly packaged wet toilet wipes.

Therefore, there has been a desire to provide a stable apparatus for dispensing toilet tissue and at least one other product and which is readily attachable to an ordinary toilet tissue roll holder without the need for any additional hardware, adhesives or the like.

SUMMARY OF THE INVENTION

In accordance with the present invention an apparatus for dispensing toilet tissue and at least one other product is provided. The apparatus is readily attachable to ordinary toilet tissue roll holders comprising a spindle and a pair of opposing holes for receiving the spindle. The apparatus is attachable to the roll holder without the need for adhesives or the like. The apparatus comprises a top wall, and two opposing side walls spaced apart by said top wall, all of which are connected together to form a housing. The housing further includes a means of receiving at least one roll of toilet tissue. The top wall is adapted for holding additional products. The housing includes a device for attaching itself to an ordinary toilet tissue roll holder using a spindle of the toilet tissue roll holder such that the housing is secured in substantially fixed relation to a wall which further secures the toilet tissue holder.

BRIEF DESCRIPTION OF THE DRAWINGS

While the specification concludes with claims particularly pointing out and distinctly claiming the subject invention, it is believed that the same will be better understood from the following description taken in conjunction with the accompanying drawings in which:

DETAILED DESCRIPTION OF THE INVENTION

Figure 1:
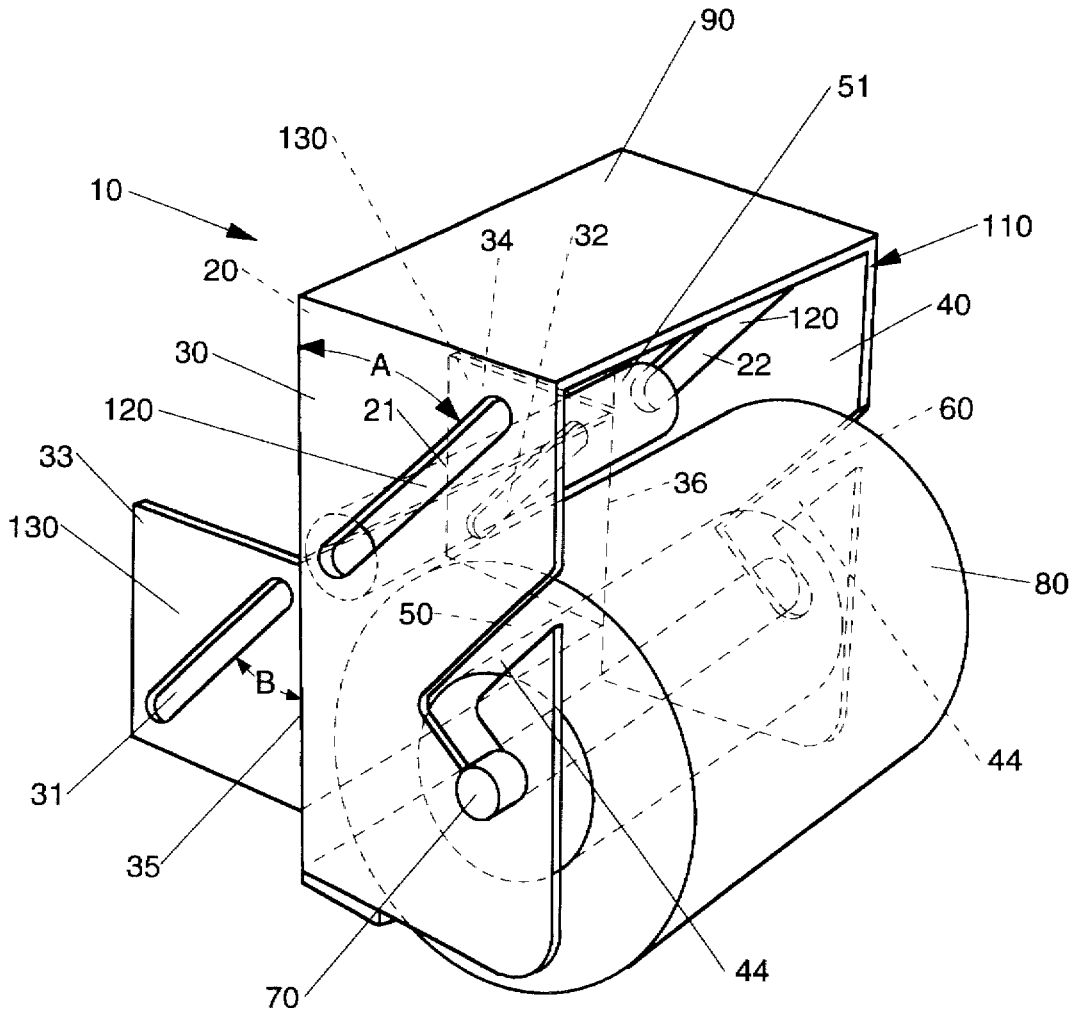
FIG. 1 is a perspective view of the apparatus in accordance with the present invention.

Referring now to the drawings in detail wherein like numerals indicate the same element throughout the views, there is shown in FIG. 1 a perspective view of one embodiment of an apparatus 10 for dispensing toilet tissue and at least one other product in accordance with the present invention.

Apparatus 10 has a top wall 90 and two opposing side walls 30 and 40 all of which are connected together to form a housing 110. In the preferred embodiments shown in FIGS. 1–5, the apparatus 10 also has a back wall 20 to provide more structural integrity to the apparatus. The top wall 90 is adapted to receive and hold another product, such as and including, but not limited to, a pre-moistened personal cleansing wipe, a different type of toilet tissue, or other personal cleansing products. A personal cleansing product made according to commonly assigned U.S. Pat. No. 5,332, 118 issued to Muckenfuhs and incorporated herein by reference is suitable for use with the claimed invention.

Apparatus 10 of FIG. 1 is designed to be attached to an existing roll holder in a secured and substantially fixed position to the roll holder and to the wall to which the roll holder is affixed, and without the need for adhesives or the like. As used herein, the term "adhesives" designates substances that bond two materials together by adhering to the surface of each, such as glue, starch paste, mucilage, rubber latex, a synthetic resin composition, cement, adhesive tape, and the like. Because toilet tissue roll holders extend out from a bathroom wall or are recessed within the wall, the apparatus 10 is more versatile if attachable to a wide range of such holders. As used herein, the terms "an ordinary wall mounted toilet tissue roll holder," "a toilet tissue roll holder," "a tissue roll holder," "a roll holder," or simply "a holder" are used interchangeably and designate a conventional holder for a roll of toilet paper, whether it is a holder extending out from a bathroom wall or a holder recessed within a bathroom wall. Apparatus 10 includes a first device 120 for attaching itself to a roll holder that extends outwardly from the wall it is affixed to, and a second device 130 for attaching itself to a roll holder that is recessed within the wall.

The first device 120 is designed to attach the housing to a roll holder 150 which extends outwardly from the wall to which it is affixed. The first device 120 comprises two opposing slots 21 and 22, one on each side wall. The first device 120 can best be described by referring to FIG. 2 which shows apparatus 10 attached to an outwardly extending roll holder 150. The slots 21 and 22 are adapted to receive a spindle 51 which for this discussion is an ordinary spring loaded spindle which is a part of the roll holder 150 and was originally designed to receive a roll of tissue. The ends of spindle 51 are inserted through the slots 21 and 22 of the housing 110 and are then inserted into the holes 52 of the roll holder 150, thereby securing the apparatus 10 to the roll holder 150 with the back wall 20, preferably substantially parallel to and secured in fixed relation to the wall to which the roll holder 150 is affixed.

Preferably, the apparatus 10 is compact. The slots 21 and 22 may be simple apertures or holes that match the size and placement of the holes 52. This, however, is impractical in that the apparatus should be able to be attached to a wide range of different roll holders. To accomplish this, the slots 21 and 22 preferably range from about 2.5 to about 4.5 inches at their longest dimension and form an included angle A relative to the back wall 20 of about 30 to about 75 degrees, as shown in FIG. 1. The smaller the included angle A, the more snug the apparatus 10 will attach itself to the roll holder.

Figure 3:
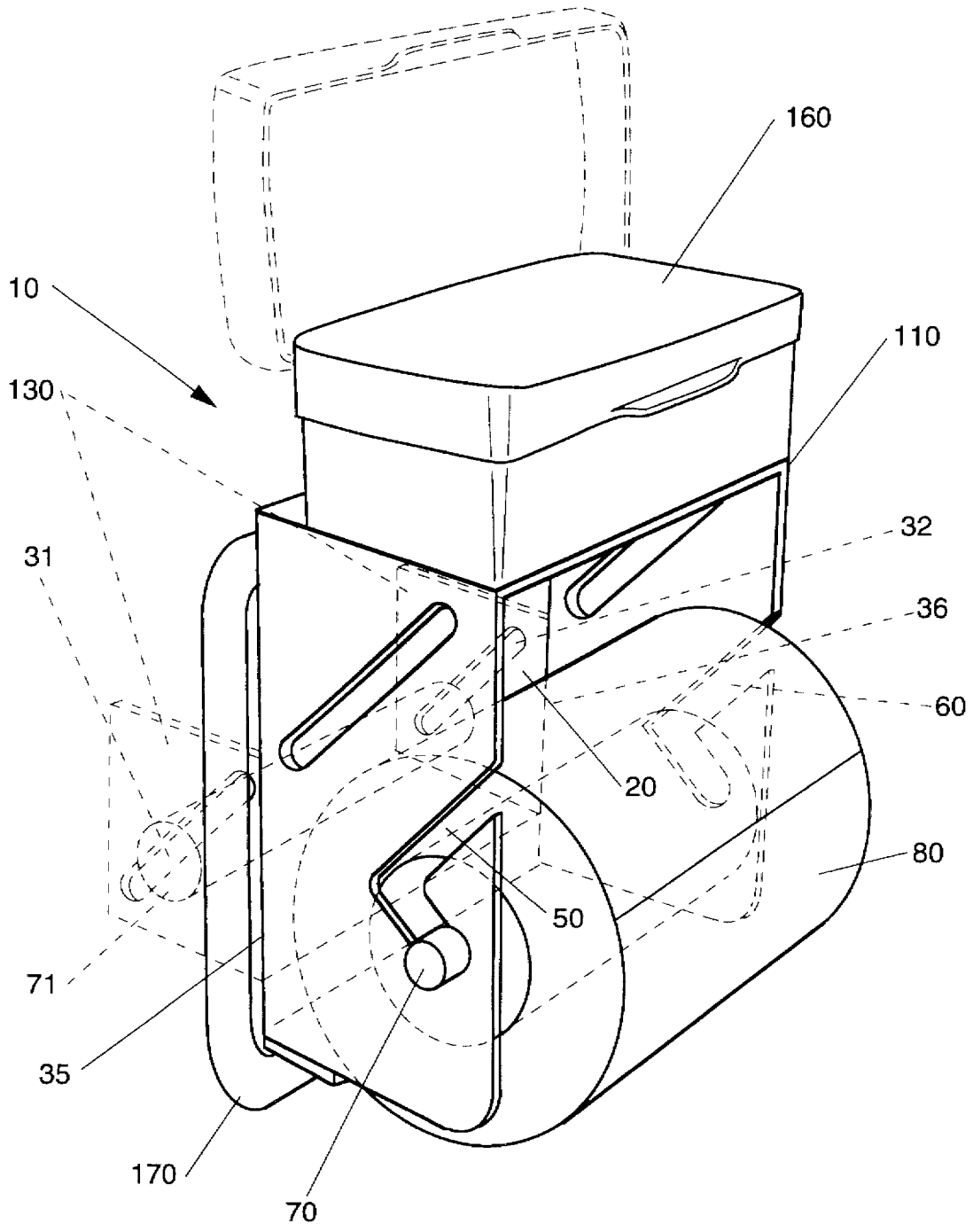
FIG. 3 and FIG. 4 are views similar to FIG. 1 showing the apparatus attached to a recessed toilet tissue roll holder.

Referring to FIGS. 1 and 3, the second device 130 is designed to attach the housing to a roll holder 170 that is recessed within the wall to which it is affixed. The second device 130 comprises two outwardly extending members 33 and 34 having two opposing slots 31 and 32. Preferably the members 33 and 34 are hinged to the housing 110 so that when the apparatus 10 is attached to the outwardly extending roll holder 150, the members 33 and 34 can articulate about hinges 35 and 36 so as to be substantially parallel with the back wall 20.

Figure 4:
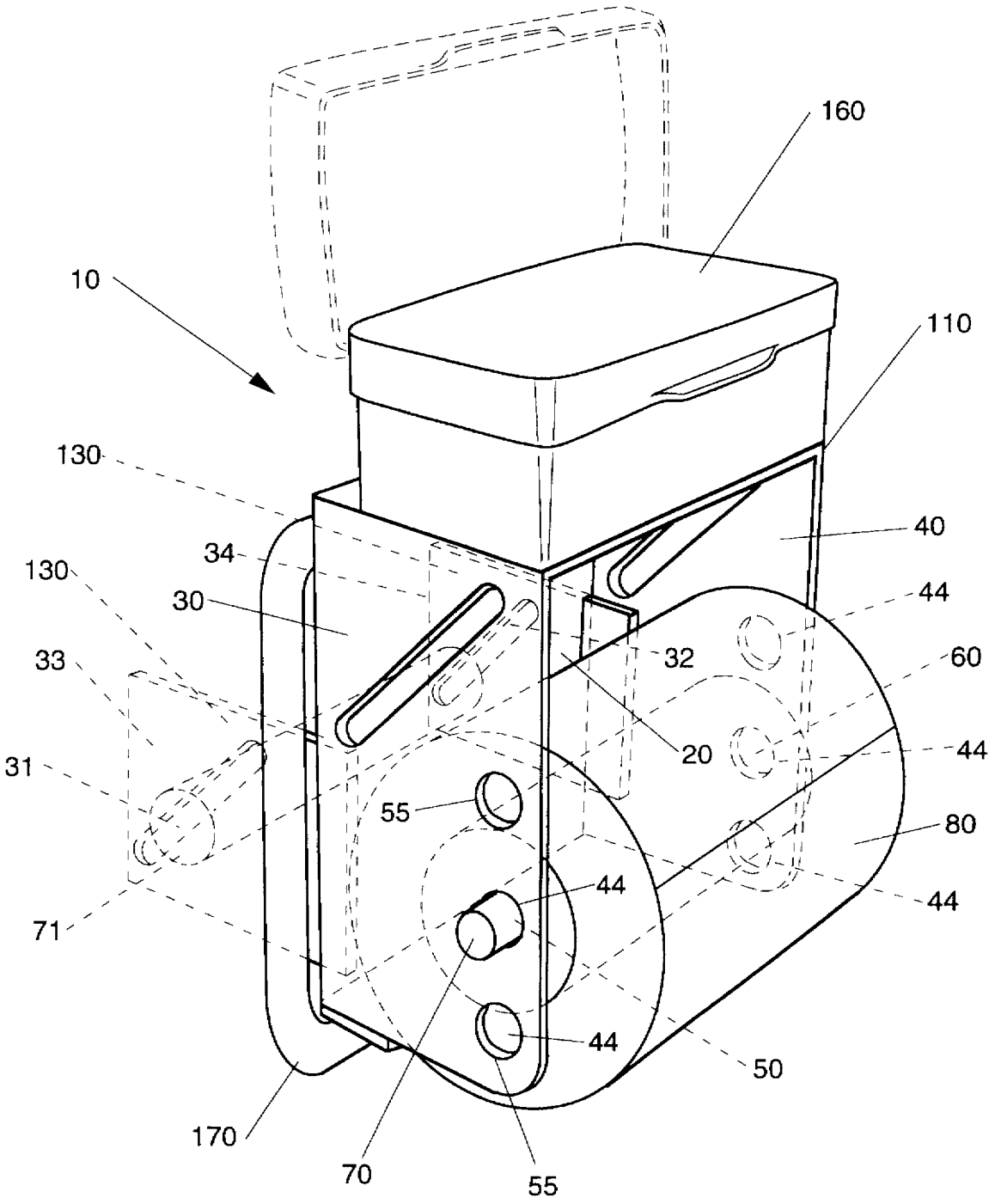

Referring to FIGS. 3 and 4, slots 31 and 32 are adapted to receive a spindle 71, which for this discussion is an ordinary spring loaded spindle 71 complementary to the roll holder 170. The ends of spindle 71 are inserted through the slots 31 and 32 of the housing 110 and are then inserted into the holes (not shown) of the roll holder 170, thereby securing the apparatus 10 to the roll holder 170 with the back wall 20 substantially parallel to and secured in fixed relation to a wall to which the roll holder 170 is affixed.

In the embodiment shown in FIG. 4, members 33 and 34 are slidably extendible from the housing 110. When not in use, the members 33 and 34 are retracted so that they do not project beyond the housing 110. When in use, the members 33 and 34 are extended from the housing 110 to be attached to a recessed roll holder 170. The slots 31 and 32 may be simple holes that match the size and placement of the holes of roll holder 170. Similarly to the slots 21 and 22, the slots 31 and 32 preferably range from about 2.5 to about 4.5 inches at their longest dimension and form an included angle B with back wall 20 of about 30 to about 75 degrees, as shown in FIG. 1. The pairs of slots 21–22 and 31–32 may have the same length and be disposed at the same included angle A, B.

Figure 5:
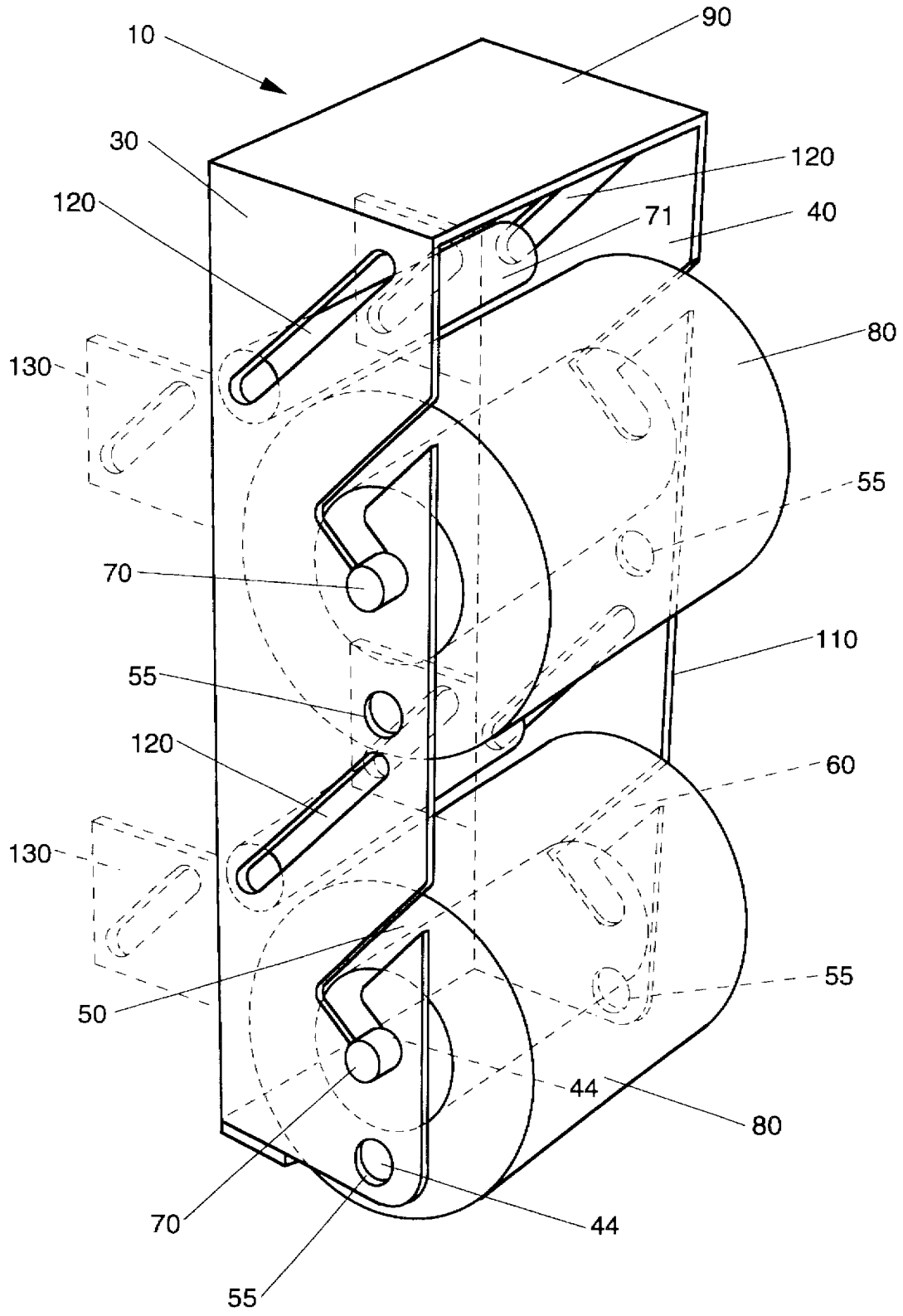
FIG. 5 is a perspective view of the embodiment of the apparatus adapted to receive two rolls of toilet tissue and another product.

The apparatus further includes a structure 44 for receiving at least one roll of toilet tissue. In the preferred embodiment of the present invention, the structure 44 comprises at least one pair of opposing slots 50 and 60 disposed on side walls 30 and 40. The slots are adapted to receive a spindle 70 having a roll of tissue 80 disposed thereon. FIGS. 1–3 and 5 show the slots 50, 60 as being open-ended but the slots 50, 60 could simply comprise apertures or holes designed to receive a spring loaded spindle having a roll of tissue disposed thereon, as shown in FIG. 4. As shown in FIGS. 4 and 5, the structure 44 can also comprise additional pairs of apertures 55 disposed on side walls 30 and 40 for receiving a spindle with a roll of toilet tissue 80—to give a consumer a greater flexibility in attaching the roll of a tissue 80 to the apparatus 10. As shown in FIG. 5, the structure 44 may comprise two pairs of opposing and substantially co-extending slots 50, 60. The two pairs of the slots 50, 60 are preferably spaced apart such that they are capable of receiving two spindles 70, each having a roll of tissue 80.

Figure 6:
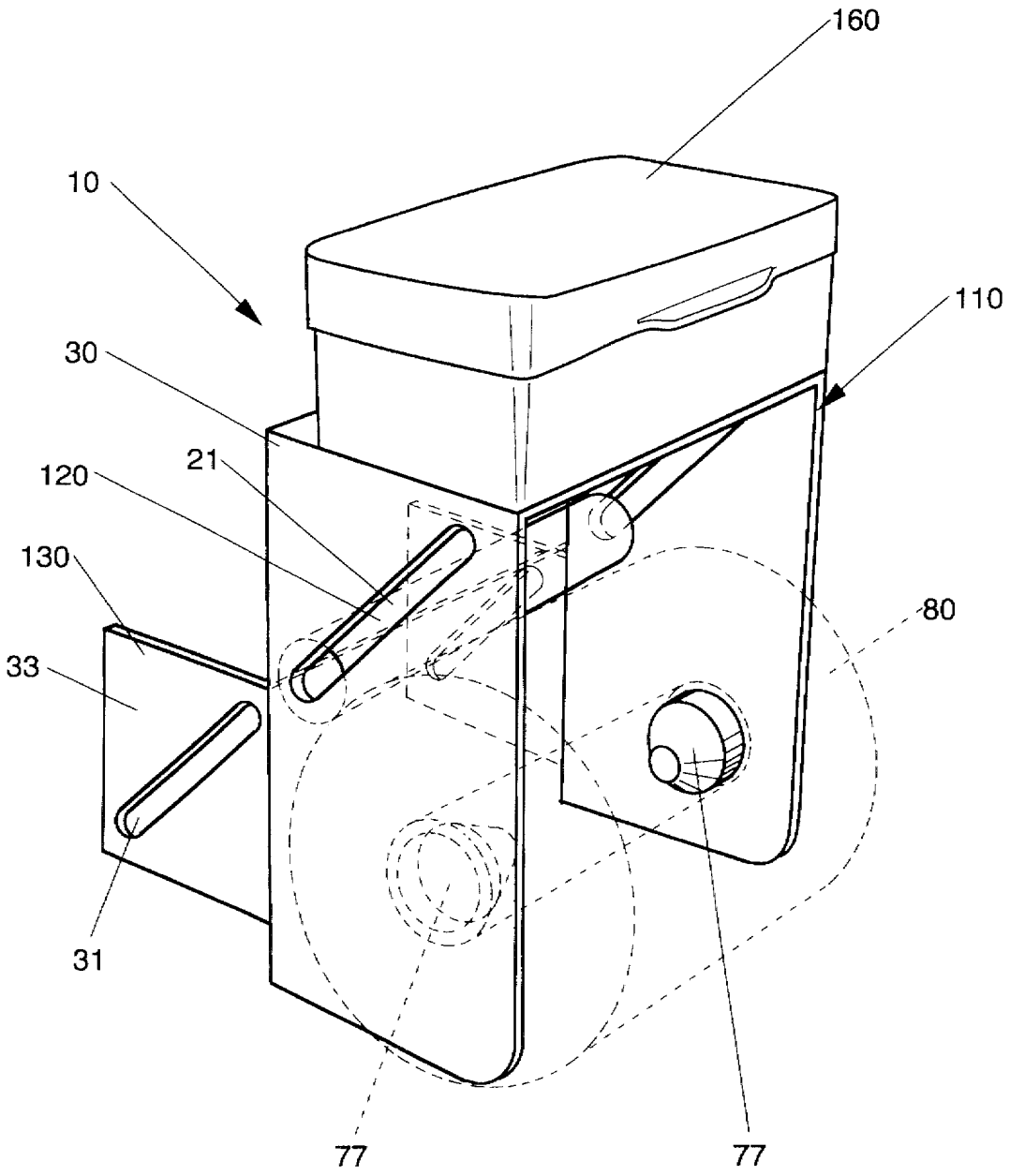
FIG. 6 is a perspective view of the embodiment of the apparatus including nubs for receiving a roll.
Figure 7:
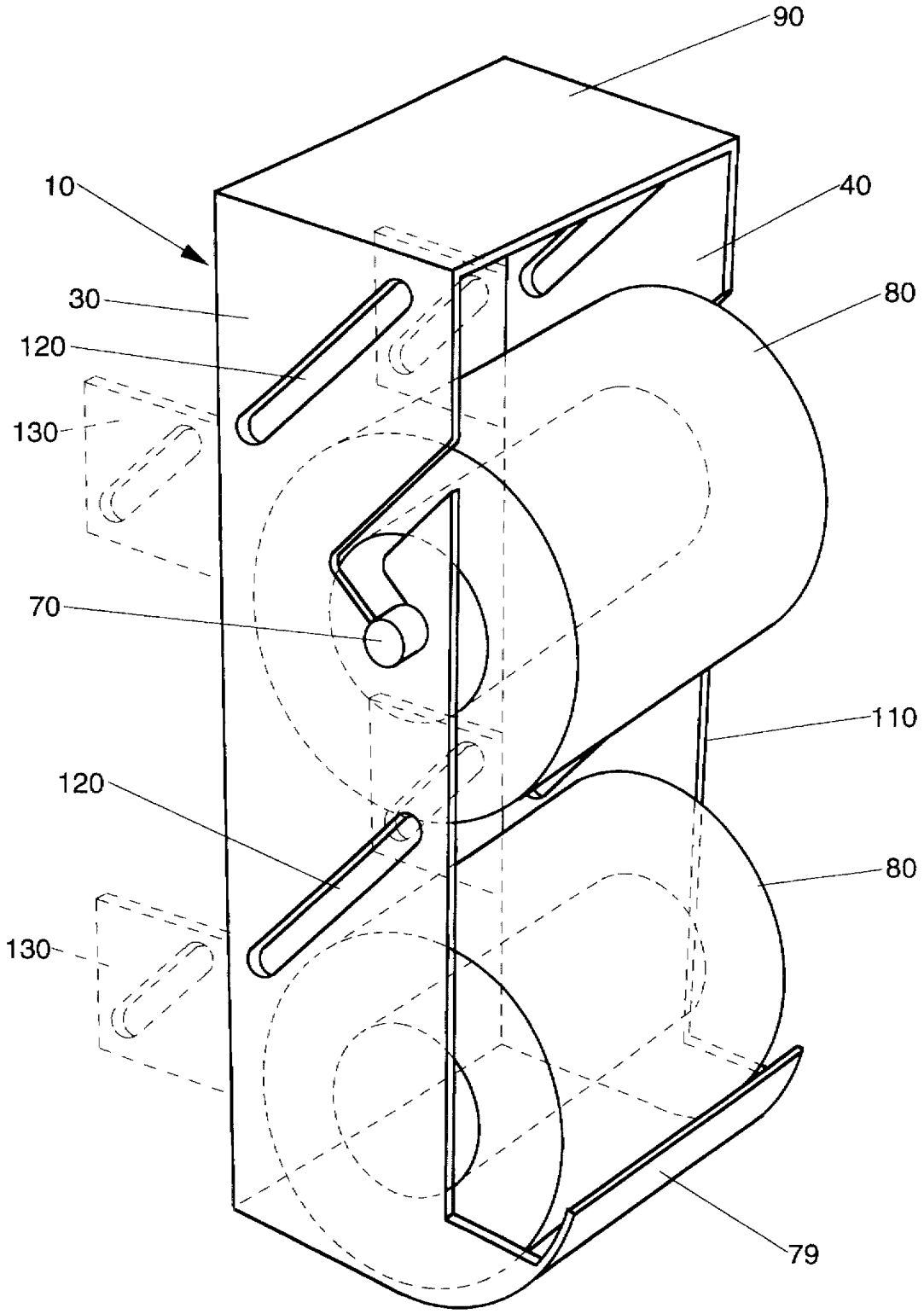
FIG. 7 is a perspective view of the embodiment of the apparatus including a concave support for a roll.

It would be apparent to one skilled in the art that the structure 44 for receiving at least one roll of toilet tissue can comprise other devices. The examples include, but are not limited to, the use of one or more pairs of opposing and substantially co-extending nubs 77, as shown in FIG. 6, and the use of concave support 79, as shown in FIG. 7. As used in this application, the term "nubs" designate protuberances disposed on opposing side walls 30 and 40, preferably within the housing 110. The protuberances preferably project towards each other and may or may not touch each other. Each pair of protuberances is adapted to receive a roll of toilet tissue. Alternatively, the structure 44 may comprise a support having concave or arcuate shape generally conforming a peripheral shape of a roll of toilet tissue. This concave support is preferably sized and disposed between the opposing side walls 30 and 40 of the housing 110 such that the roll of toilet tissue may rest within the concave portion of the support. The concave support may be shaped and disposed within the housing 110 such that the access of the roll of tissue is either vertically or horizontally oriented.

The housing 110 can be made out of any number of materials known in the art. It may be desired for promotional purposes to sell the apparatus inexpensively and make it out of paperboard or lightweight plastic. It would be apparent to one skilled in the art that the members 33 and 34, instead of being hinged to the housing 110, can be integral to the housing 110. In this case, lines of weakness extending between the members 33 and 34 and the rest of the housing 110 can perform the function of the hinges 35 and 36 so that the members 33 and 34 can be articulated about the lines of weakness. Alternatively, it may be desired to make a more permanent housing 110 of durable plastic, metal, wood or other materials. In the case of a more permanent apparatus, the housing would most likely not need both devices 120 and 130 but rather one or the other.

Figure 2:
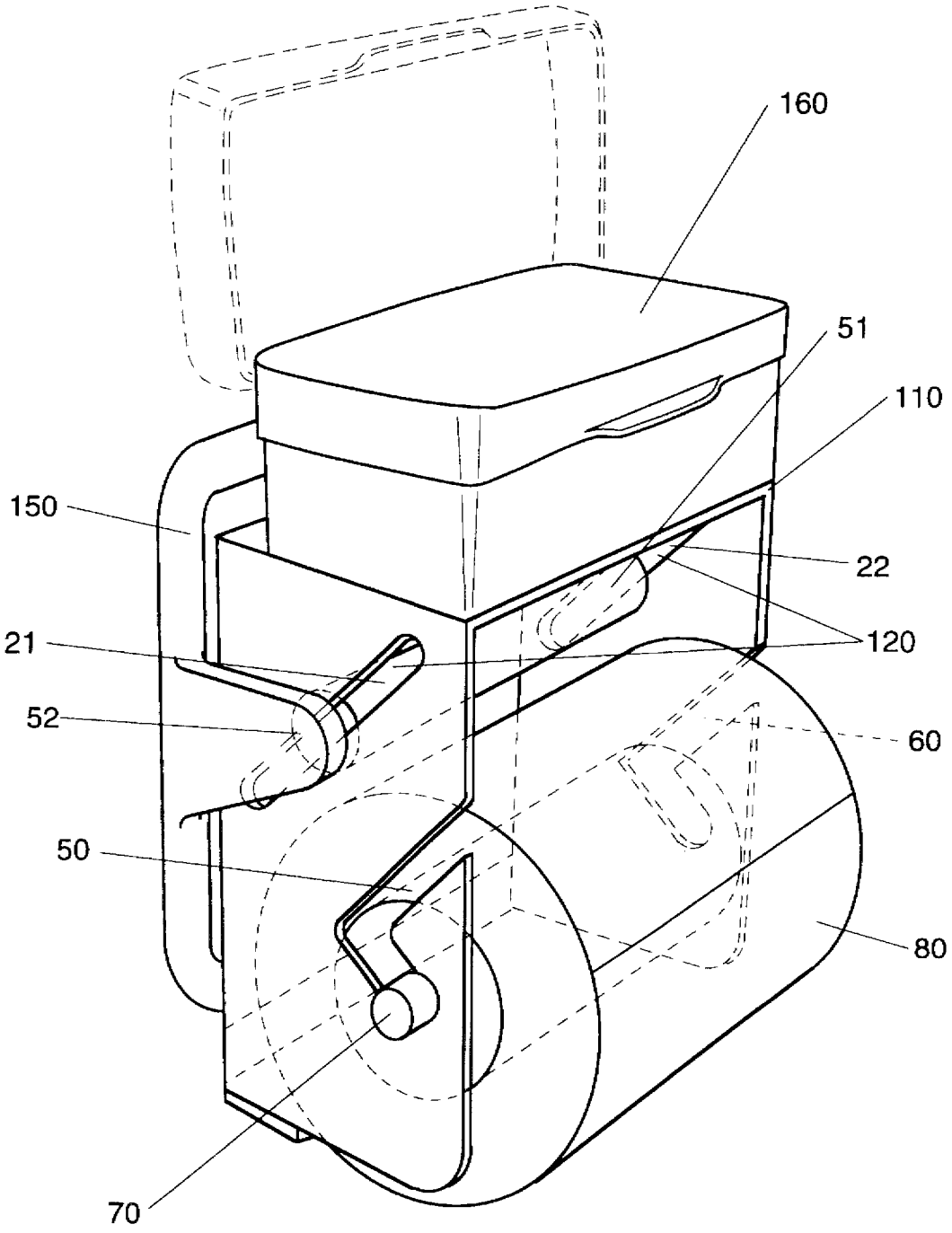
FIG. 2 is a view similar to FIG. 1 showing the apparatus attached to an ordinary outwardly extending toilet tissue roll holder.

As was stated above, the top wall 90 of the housing 110 is adapted to receive at least one other product. In the embodiment of FIG. 1 the top wall 90 comprises a substantially planer surface 40, which is an integral part or the top wall 90. The planer surface 40 will be generally level and horizontal when the apparatus 10 is attached to a roll holder 50. The planer surface 40 thereby works with gravity to be able to receive an additional product. FIGS. 2–4 show a product 160 which can hold a number of personal products. Product 160 shown in FIGS. 2–4 comprises a commonly available product, in any suitably sized container.

There are a variety of couplers for receiving product 160. A wide range of adhesives such as two sided tape or hook and loop fasteners between the product 160 and the top wall 90 can optionally be used to ensure the product 160 does not inadvertently fall from the planar surface 40. The attachment of the product 160 to the apparatus could be permanent and done during manufacture or can be releasable and done by the consumer. It will be apparent to one skilled in the art that the container of the product 60 can be made an integral and inseparable part of the housing 110. A ledge can also be used to hold the product 160 on the top wall 90.

The scope of the present invention should be considered in terms of the following claims and is understood not to be limited to the details described and shown in the specification and drawings.

What is claimed is:

1. An apparatus for dispensing toilet tissue and at least one other product, said apparatus being attachable to a wall-mounted toilet tissue roll holder comprising a spindle of the roll holder and a member having a pair of opposing holes for receiving the spindle of the roll holder, said apparatus comprising:

a top wall and two opposing side walls spaced apart by said top wall, all of which are connected together to form a housing, said housing having two substantially rigid members joined thereto for attaching said housing to the roll holder, each of said rigid members being articulably hinged to said housing to be articulated from a position substantially parallel with a wall to which the roll holder is affixed to a position outwardly extended from said housing, each of said members having at least one slot therein for receiving the spindle of the roll holder such that when said apparatus is attached to the roll holder said apparatus is secured in substantially fixed relation to the roll holder, said housing further including a structure for receiving at least one roll of toilet tissue, said top wall being adapted to receive an additional product.

2. The apparatus of claim 1, wherein said slots on said rigid members outwardly extended from said housing range at their longest dimension from about 2.5 to about 4.5 inches and form an included angle of about 30 to about 75 degrees relative to said back wall of said housing.

3. The apparatus of claim 2, wherein said housing further includes a back wall connected to at least one of said top wall and said side walls, said back wall being generally parallel with the wall to which the roll holder is affixed.

4. The apparatus of claim 2 or claim 3, wherein said structure for receiving at least one roll of toilet tissue comprises at least one pair of opposing and substantially co-extending slots disposed on said opposing side walls of said housing, each said at least one pair receiving a spindle having the roll of toilet tissue disposed thereon.

5. The apparatus of claim 2 or claim 3, wherein said structure for receiving at least one roll of toilet tissue comprises at least one pair of opposing and substantially co-extending nubs disposed on said opposing side walls of said housing, for receiving the roll of toilet tissue.

6. The apparatus of claim 2 or claim 3, wherein said structure for receiving at least one roll of toilet tissue comprises a concave support having an arcuate shape generally conforming to a peripheral shape of the roll of toilet tissue and disposed between said opposing side walls of said housing such that the roll of toilet tissue may rest within said concave support.

7. An apparatus for dispensing toilet tissue and a personal cleansing product, said apparatus being attachable to a wall-mounted toilet tissue roll holder comprising a spindle of the roll holder and a member having a pair of opposing holes for receiving the spindle of the roll holder, said apparatus comprising:

a top wall and two opposing side walls spaced apart by said top wall, all of which are connected together to form a housing, said housing including a first device and a second device for attaching said housing to the roll holder in a secured and substantially fixed relation thereto, said housing further including a structure for receiving at least one roll of toilet tissue, said top wall being adapted to receive an additional product, said first device comprising a pair of opposing and substantially co-extending slots, one on each of said opposing side walls of said housing, for receiving the spindle of the roll holder, and said second device comprising two substantially rigid members joined to said housing, each of said members being articulably hinged to said housing to be articulated from a position substantially parallel with a wall to which the roll holder is affixed to a position outwardly extended from said housing, each of said members having at least one slot therein for receiving the spindle of the roll holder.

8. The apparatus of claim 7, wherein said slots on side walls and said slots on said rigid members outwardly extended from said housing range from about 2.5 to about 4.5 inches at their longest dimension and form an included angle of about 30 to about 75 degrees relative to the wall to which a toilet tissue roll holder is affixed.

9. The apparatus of claim 8, wherein said structure for receiving at least one roll of toilet tissue comprises at least one pair of opposing and substantially co-extending slots disposed on said opposing side walls of said housing, each said at least one pair receiving a spindle having the roll of toilet tissue disposed thereon.

10. The apparatus of claim 9, wherein said structure for receiving at least one roll of toilet tissue comprises two pairs of opposing and substantially co-extending slots disposed on said opposing side walls of said housing, each of said two pairs receiving the spindle having the roll of toilet tissue disposed thereon.

11. The apparatus of claim 8, wherein said structure for receiving at least one roll of toilet tissue comprises at least one pair of opposing and substantially co-extending nubs disposed on said opposing side walls of said housing, for receiving the roll of toilet tissue.

12. The apparatus of claim 8, wherein said structure for receiving at least one roll of toilet tissue comprises a concave support having an arcuate shape generally conforming to a peripheral shape of the roll of toilet tissue and disposed between said opposing side walls of said housing such that the roll of toilet tissue may rest within said concave support.

13. An apparatus for dispensing toilet tissue and a personal cleansing product, said apparatus being attachable to a wall-mounted toilet tissue roll holder comprising a spindle of the roll holder and a member having a pair of opposing holes for receiving the spindle of the roll holder, said apparatus comprising:

a top wall, a back wall, and two opposing side walls spaced apart by said top wall, all of which are connected together to form a housing, said housing including a first device and a second device for attaching said housing to the roll holder in a secured and substantially fixed relation thereto, said housing further including a structure for receiving at least one roll of toilet tissue, said top wall being adapted to receive an additional product, said first device comprising a pair of opposing and substantially co-extending slots, one on each of said opposing side walls of said housing, for receiving the spindle of the roll holder, and said second device comprising two substantially rigid members joined to said housing, each of said members being articulably hinged to said housing to be articulated from a position substantially parallel with a wall to which the roll holder is affixed to a position outwardly extended from said housing, each of said members having at least one slot therein for receiving the spindle of the roll holder.

14. The apparatus of claim 13, wherein said slots on side walls and said slots on said rigid members outwardly extended from said housing range from about 2.5 to about 4.5 inches at their longest dimension and form an included angle of about 30 to about 75 degrees relative to said back wall.

15. The apparatus of claim 14, wherein said structure for receiving at least one roll of toilet tissue comprises at least one pair of opposing and substantially co-extending slots disposed on said opposing side walls of said housing, each said at least one pair receiving a spindle having the roll of toilet tissue disposed thereon.

16. The apparatus of claim 14, wherein said structure for receiving at least one roll of toilet tissue comprises at least one pair of opposing and substantially co-extending nubs disposed on said opposing side walls of said housing, for receiving the roll of toilet tissue.

17. The apparatus of claim 14, wherein said structure for receiving at least one roll of toilet tissue comprises a concave support having an arcuate shape generally conforming to a peripheral shape of the roll of toilet tissue and disposed between said opposing side walls of said housing such that the roll of toilet tissue may rest within said concave support.

* * * * *

UNITED STATES PATENT AND TRADEMARK OFFICE
CERTIFICATE OF CORRECTION

PATENT NO. : 5,618,008

DATED : April 8, 1997

INVENTOR(S) : DONALD D. DEARWESTER ET AL.

It is certified that error appears in the above-identified patent and that said Letters Patent is hereby corrected as shown below:

On the title page: Item [54] and Column 1, line 2, after "Multiple" delete "Productions" and insert therefor --Products--.

Column 5, line 9, "or" should read -- of --.

Signed and Sealed this

Nineteenth Day of August, 1997

*Attest:*

*Attesting Officer*

BRUCE LEHMAN

*Commissioner of Patents and Trademarks*